US007841485B1

(12) United States Patent
Rodriguez

(10) Patent No.: US 7,841,485 B1
(45) Date of Patent: Nov. 30, 2010

(54) ANTI-CONTAMINATION SEAL AND DRINKING STRAW FOR A BEVERAGE CONTAINER

(76) Inventor: Otto M Rodriguez, 14172 SW. 156 Ave., Miami, FL (US) 33196

( * ) Notice: Subject to any disclaimer, the term of this patent is extended or adjusted under 35 U.S.C. 154(b) by 6 days.

(21) Appl. No.: 12/437,104

(22) Filed: May 7, 2009

(51) Int. Cl.
*A47G 19/00* (2006.01)

(52) U.S. Cl. ..... 220/708

(58) Field of Classification Search ..... 220/708, 220/707, 705, 906, 270, 266, 265, 260, 254.1, 220/359.2, 395.1, FOR. 203, 212, 703, 522; 215/229, 228, 388, 387, 232, 200; D7/635, D7/300.2; 53/420; *B65D 77/28*
See application file for complete search history.

(56) References Cited

U.S. PATENT DOCUMENTS 2,844,267 A * 7/1958 Petriccione ..... 215/388
3,197,057 A * 7/1965 Weitzner ..... 215/388
3,385,501 A * 5/1968 Chang ..... 229/103.1
3,623,632 A * 11/1971 Chang ..... 229/103.1
3,874,554 A * 4/1975 Chang ..... 220/708
4,247,016 A * 1/1981 Shaw ..... 220/708
4,728,001 A * 3/1988 Serba ..... 220/705
4,923,083 A * 5/1990 Forbes ..... 220/705
4,923,084 A * 5/1990 Forbes ..... 220/705
5,522,524 A * 6/1996 Nmngani ..... 220/710
5,769,263 A * 6/1998 Willingham et al. ..... 220/522
5,984,127 A * 11/1999 Fenton ..... 220/254.1
6,427,864 B1 * 8/2002 Asselin ..... 220/709
2006/0006134 A1 * 1/2006 Luo ..... 215/388
2006/0180593 A1 * 8/2006 White ..... 220/705

* cited by examiner

*Primary Examiner*—Anthony Stashick
*Assistant Examiner*—Robert J Hicks
(74) *Attorney, Agent, or Firm*—David Kiewit

(57) ABSTRACT

Beverage containers can be sealed against various sorts of contamination by a sealing member having, on its underside, generally circular channels arranged to hold a drinking straw. When the liquid is to be dispensed, the flexible sealing member is pulled off the rim of the container, the straw is retrieved from the channels on the sealing member, a conventional pop-top is used to open the container, and the straw is inserted into the container so that the consumer can drink the liquid.

1 Claim, 2 Drawing Sheets

ANTI-CONTAMINATION SEAL AND DRINKING STRAW FOR A BEVERAGE CONTAINER

BACKGROUND OF THE INVENTION

1. Field of the Invention

The invention relates to beverage containers and, more particularly, to apparatus and method for sealing beverages against various sorts of contamination.

2. Background Information

For many years beer and carbonated soft drinks have been sold in cylindrical aluminum cans. In these cans an openable surface—i.e., the can top—comprises an opening device commonly referred to as a pop-top. Although some pop-tops are configured so that pulling on a tab rips out a portion of the top, most current pop-tops are configured so that lifting a tab partially tears out a portion of the top and pushes the torn-out portion into the can.

Dirt and contamination on the top of the container can be carried into the beverage when the pop-top is opened and a flap of aluminum is pushed into the liquid. Additional contamination can occur when the beverage is poured from the can into a glass, or when someone drinks directly from the can and puts his or her mouth on a dirty surface of the can.

BRIEF SUMMARY OF THE INVENTION

One aspect of the invention is that it provides a combination of a liquid container, a drinking straw and a flexible impermeable sealing member. In this combination the liquid container comprises an openable upper end having a lifting tab or pop-top that can be used to open the container by bending a portion of the openable end into the interior of the container. The drinking straw used in this combination is flexible enough to be coiled and has a diameter that is less than the height by which a rim of the container extends above the upper surface. The preferred flexible impermeable sealing member has a circular channel on its bottom surface for receiving the coiled straw. A peripheral portion of the flexible sealing member is attached to the upstanding rim of the container so as to prohibit dirt and contaminants from reaching either the top of the container or the drinking straw.

Another aspect of the invention is that it provides a method of prohibiting contaminants from being deposited on an openable end of a pop-top liquid container and of providing a drinking straw free of contamination when the container is opened. The method involves using a flexible impermeable sealing member having a size and shape selected to cover the openable end of the container. In some cases the sealing member may extend along the cylindrical wall of the container from the openable end to beyond a necked-down portion of the container. In these arrangements the impermeable sealing member preferable has a circular channel on a bottom surface to receive a coiled straw. The sealing member, with the straw in the channel, is placed on and adhered to either a rim of the container or to the cylindrical wall thereof. In these arrangements the coiled straw is captured between the sealing member and the openable end of the container.

When the liquid is to be dispensed, the flexible sealing member is pulled off the rim of the container, the straw is retrieved from the sealing member, the pop-top is used to open the container, and the straw is inserted into the container so that the consumer can drink the liquid.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT

Figure 1:
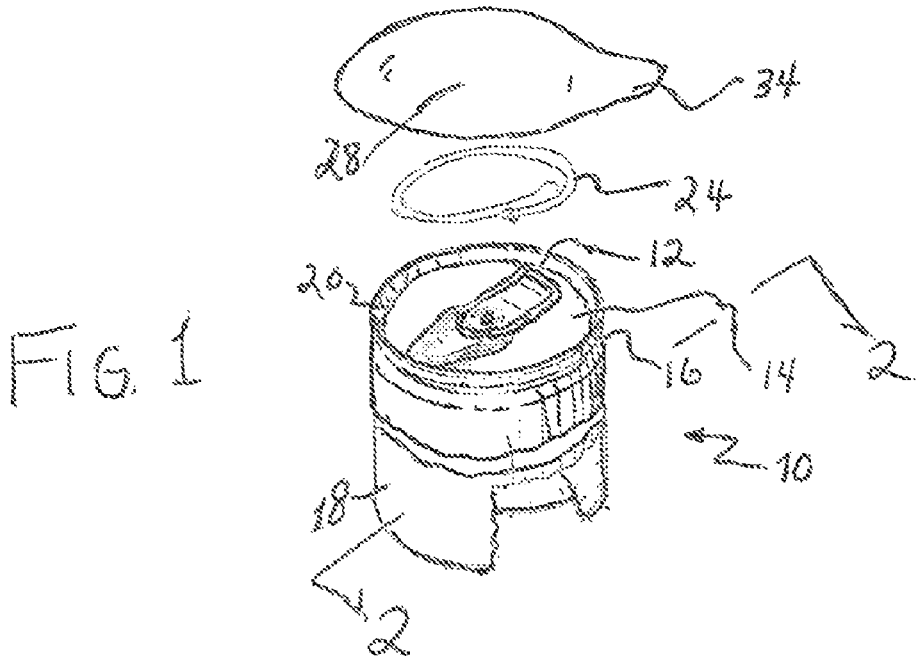
FIG. 1 is an exploded view of a first embodiment of the invention.
Figure 2:
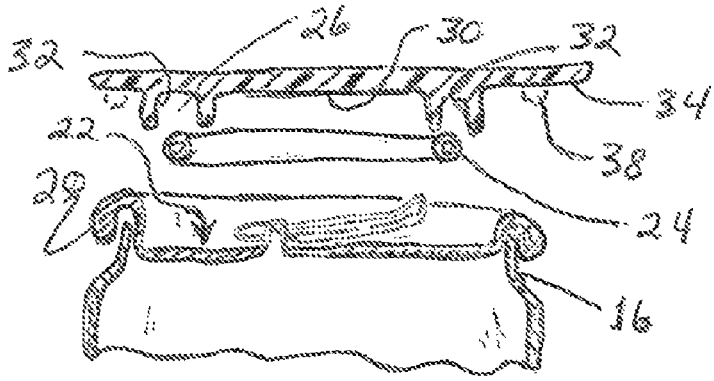
FIG. 2 is an exploded cross-sectional view, the section taken as indicated by the arrow 2-2 in FIG. 1.

Turning now to the drawing, one finds a beverage can 10 having a pop-top tab 12 on an upper, openable end 13. As is conventional in the art, the can is a generally cylindrical container having a necked-down region 16 adjacent its upper, openable, end 13 and having an openable end member 14 attached to the body 18 of the can by a means of a rolling operation that leaves the can with a pronounced rim 20 extending above a major portion of the openable end by a selected height.

The depicted pop-top arrangement is of a conventional sort and comprises a tab 12 that, when lifted, opens the container by at least partially severing a portion of the can top and forcing that portion downward into the interior of the can. The skilled reader will appreciate that this choice of pop-top is illustrative only, and that the sealing arrangement of the invention is compatible with a wide variety of pop-top designs, including those that result in both a tab and a portion of the top being separated from the can.

A preferred pop-top design uses a lifting tab 12 that extends only part of the way from the center of the openable end of the can to the rim thereof. In particular, a preferred design leaves a marginal area 22 between the tab 12 and the rim 20 that is large enough to comfortably receive a coiled drinking straw 24 disposed within a channel portion 26 of a flexible impermeable sealing member 28.

A preferred drinking straw 24 is capable of being coiled and uncoiled without kinking or otherwise deforming. Thus, a conventional rigid plastic or waxed paper straw would not be desirable. An accordion-pleated straw, on the other hand, could be used. In a particular preferred embodiment the straw is made of a material selected so that it can be coiled and inserted into a channel in the sealing member, but that straightens when removed from the channel.

A flexible, impermeable sealing member 28 preferably comprises a polymeric sheet having a generally circular channel 26 formed on a bottom surface 30. In this arrangement the walls 32 of the channel are selected to be strong enough to retain a coiled straw 24 in its coiled state, even if the straw has a preferred straight configuration and imposes a spring bias on the walls of the channel.

In some embodiments the sealing member is generally circular and is sized to fit on top of the openable end of the container. This member may comprise a seal pull tab 34, distinct from the pop-top tab 12, extending outwardly from one side of the rim of the can. This allows a user to grasp the seal pull tab 34 and pull the sealing member away from the top of the can in order to retrieve the straw and to open the can by operating whatever pop-top mechanism is used.

Figure 3:
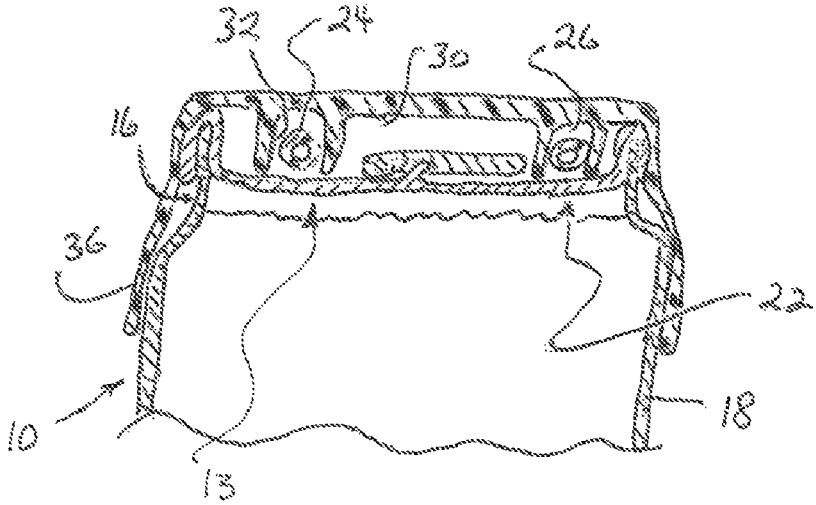
FIG. 3 is a cross-sectional view, similar to that of FIG. 2, but showing a second embodiment of the invention.

In other embodiments, as depicted in FIG. 3, the sealing member 28 may have a cup-like configuration and be sized to fit snugly over the openable end of the can. In these embodiments the sealing member 28 has a skirt portion 36 extending along the cylindrical body of the can 18. This skirt portion 36 is preferably long enough to extend beyond any necked-down portion 16 of the can so as to prohibit dirt and contaminants from collecting along this portion of the can. Moreover, the skirt can be selected to be long enough to cover any portion of the can that a user's lip may contact after he or she peels away the sealing member, opens the can and drinks directly from it.

The sealing member 28 is preferably made from a flexible material that is impermeable to common sorts of dirt and contamination. It may be made of corrugated aluminum foil, a plastic, a metal-coated plastic or any other material that provides the desired combination of flexibility and impermeability.

In a preferred method of assembly a drinking straw 24 is coiled and inserted into a channel 26 formed on a bottom surface 30 of a sealing member 28. The preferred channel 26 has a depth substantially equal to the height of the rim 20 of the can 10. The sealing member or the rim of the can may be provided with a bead of adhesive 38 before the two items are pushed together and adhesively bonded. Although the preferred approach involves gluing the sealing member onto the can, the skilled reader will appreciate that many other approaches can be used and that these include, without limitation, heat shrinking the seal around the rim of the can, and mechanically deforming the peripheral portion of the sealing member onto the rim of the can.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. Apparatus comprising in combination a liquid container, a drinking straw and a flexible impermeable sealing member, wherein:

the liquid container comprises an openable end having an upstanding rim portion having a selected height, the openable end further comprising a lifting tab operable to open the container by bending a portion of the openable end into an interior portion of the liquid container;

the drinking straw comprises a coiled tube having a diameter no greater than the selected height of said upstanding rim portion; and the flexible impermeable sealing member comprises a top surface and a bottom surface, the bottom surface of the sealing member attached to the container to seal the openable end of the container from contaminants, the bottom surface of the flexible sealing member having a circular channel defined thereon by spaced apart walls, the channel having a width, between the spaced apart walls, selected to receive the coiled drinking straw, the channel fitting within a marginal space between the lifting tab and the rim of the can.

* * * * *